US005119664A

United States Patent [19]

Schubert

[11] Patent Number: 5,119,664

[45] Date of Patent: Jun. 9, 1992

[54] ALL PURPOSE INTEGRAL RIVET AND METHOD OF FORMING SAME

[75] Inventor: James R. Schubert, Dayton, Ohio

[73] Assignee: Dayton Reliable Tool & Mfg. Co., Dayton, Ohio

[21] Appl. No.: 615,043

[22] Filed: Nov. 19, 1990

[51] Int. Cl.[5] ..... B21D 51/38

[52] U.S. Cl. ..... 72/356; 72/379.2

[58] Field of Search ..... 72/343, 354.6, 354.8, 72/347, 348, 349, 356, 379.2, 377; 413/56, 66

[56] References Cited

U.S. PATENT DOCUMENTS

| | | | |
|---|---|---|---|
| 3,194,047 | 7/1965 | Eggert, Jr. et al. | 72/349 |
| 3,361,102 | 1/1968 | Rouse | 72/349 |
| 3,387,481 | 6/1968 | Harvey et al. | 72/379.2 |
| 3,391,819 | 7/1968 | Henchert | 220/54 |
| 3,457,761 | 7/1969 | Brosseit | 72/347 |
| 3,583,348 | 6/1971 | Brown | 113/121 |
| 3,638,597 | 2/1972 | Brown | 113/116 FF |
| 4,568,230 | 2/1986 | Brown | 413/66 |

OTHER PUBLICATIONS

Alcoa Product Data Rigid Container Sheet Jan. 1, 1986.

*Primary Examiner*—Lowell A. Larson

*Attorney, Agent, or Firm*—Joseph G. Nauman

[57] ABSTRACT

An improved integral rivet button and resulting rivet, and a process and tooling for forming such button, utilizes successive coining steps on material surrounding the base of an initial bubble formed on a can end, causing flow of material along the wall of the button toward its center. The successive coining at progressively lesser radii affords adequate metal in the bubble region to assure ultimate formation of an accurate button, assures a strong boundary region about the base of the button, and assures the rivet head is sufficiently large to prevent tear out of the tab at its juncture with the rivet. The initial coined boundary is located close to the juncture of the initial bubble wall with the remainder of the shell, where curvature of the initial bubble wall is concave in the direction of the bubble top and toward the ultimate public side of the end. Subsequent coining at one or more locations radially inward from the initial coined boundary causes material to flow into the region from which the button ultimately is formed, and such material is reshaped into a precise button form having improved overall thickness and strength. Tooling design is such that intermediate shapes formed at progressive tool stations are compatible with next tooling stations to promote smooth transition of metal.

21 Claims, 11 Drawing Sheets

FIG. 1A
PRIOR ART
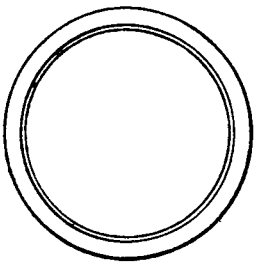
FIG. 1B
PRIOR ART
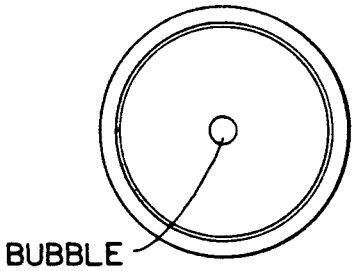
FIG. 1C
PRIOR ART
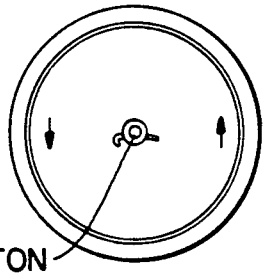
FIG. 1D
PRIOR ART
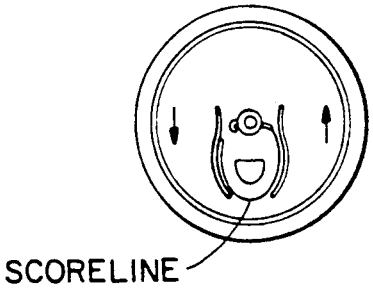
FIG. 1E
PRIOR ART
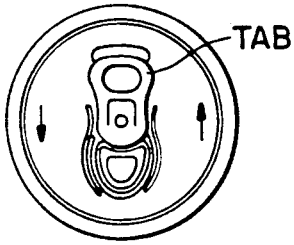
FIG. 2A
PRIOR ART
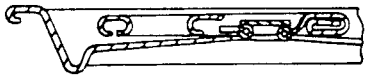
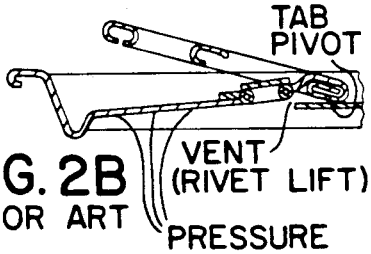
FIG. 2B
PRIOR ART
FIG. 2C
PRIOR ART
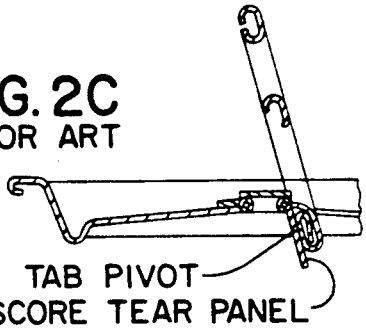
FIG. 3A
PRIOR ART
FIG. 3B
PRIOR ART
FIG. 3C
PRIOR ART
FIG. 3D
PRIOR ART
FIG. 3E
PRIOR ART
FIG. 3F
PRIOR ART
FIG. 3G
PRIOR ART
FIG. 3H
PRIOR ART
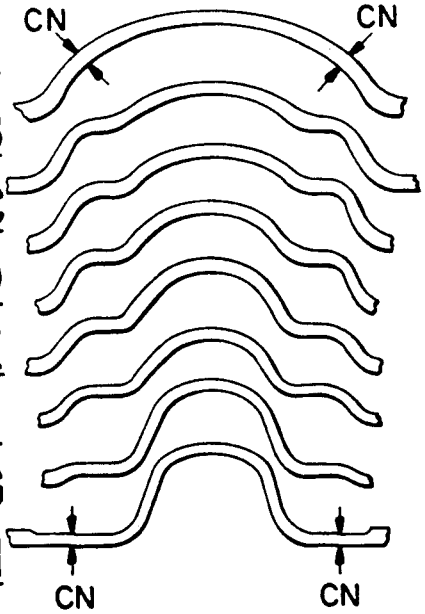

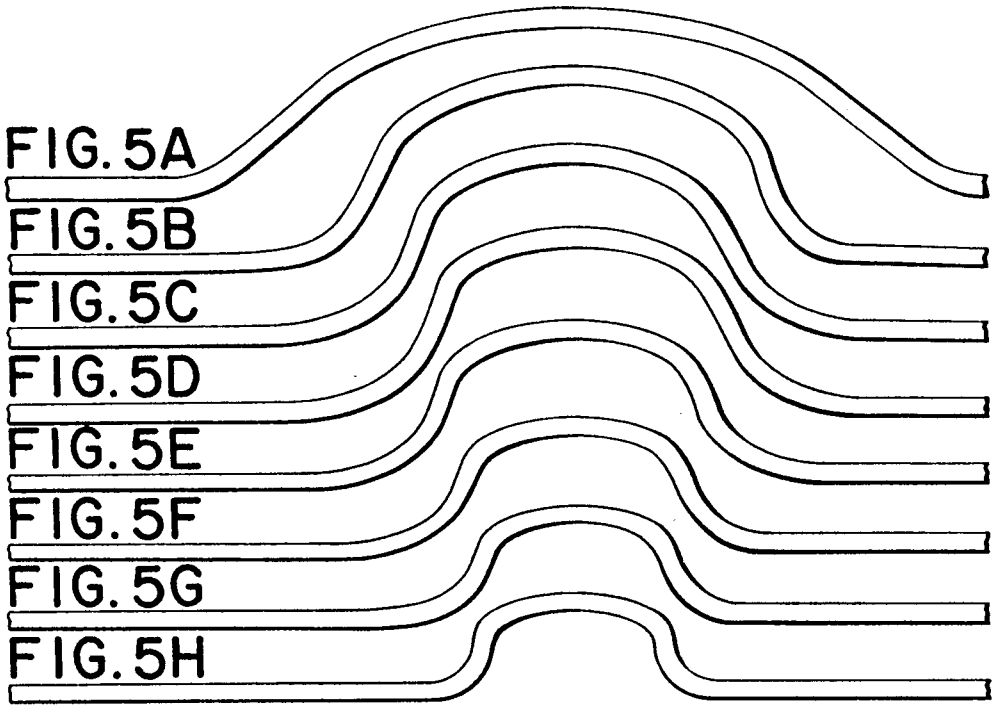
FIG. 5A
FIG. 5B
FIG. 5C
FIG. 5D
FIG. 5E
FIG. 5F
FIG. 5G
FIG. 5H
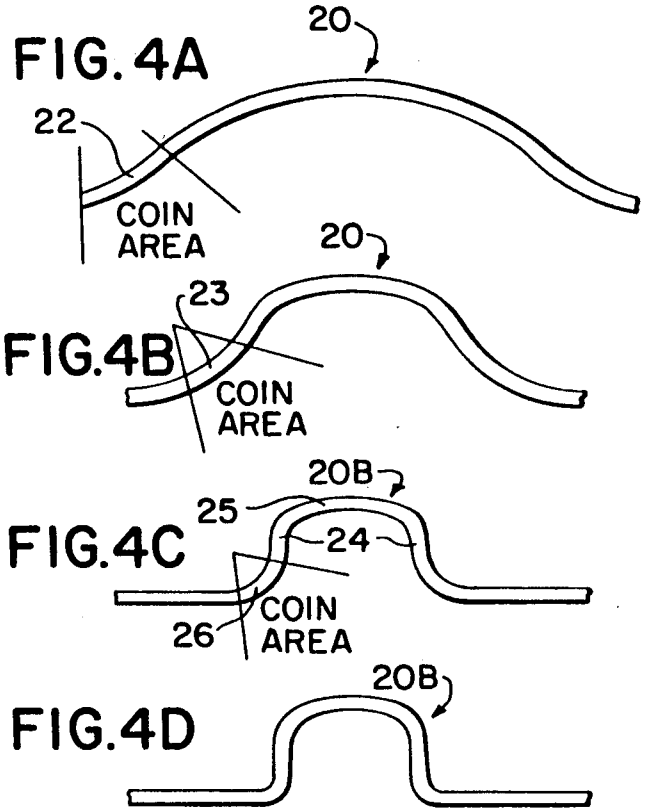
20
22
COIN AREA
FIG. 4A
20
23
COIN AREA
FIG. 4B
20B
24
25
26
COIN AREA
FIG. 4C
20B
FIG. 4D

BUBBLE/I.D.

SECOND BUBBLE

BUTTON & PANEL COIN

1ST. FORM & BUTTON RESTRIKE

SCORE

2ND. FORM

IDLE

STAKE

ALL PURPOSE INTEGRAL RIVET AND METHOD OF FORMING SAME

BACKGROUND OF THE INVENTION

This invention relates to forming integral rivet joints, particularly as used in the attachment of operating tabs to metal self-opening can ends. The basic form of integral rivet construction for self-opening can ends, which has been commercially quite successful for the past thirty years, was the basis for a world-wide change in the can packaging industry. At present billions of metal cans are used for beverages, foods, and other materials, all featuring some form of self-opening construction. This seemingly simple configuration has, in fact, many complexities which are not apparent to the casual viewer.

Self-opening or "easy open" can ends basically consist of two parts. These are (1) the shell, which is the major element and (in cylindrical cans) is a disc-like member have a pre-formed perimeter which will later be attached to a full can body, (2) the tab, which is the operating part during the self-opening procedure, and (3) the integral rivet structure which joins the tab to the shell. The completed joined shell and tab constitute a self-opening end. A score on the shell defines an opening panel which is at least partially separated from the shell material during opening action of the tab. Many beverage cans now employ a retained tab, which remains attached to the end after the opening action.

Basically, the integral rivet is formed of an area, usually referred to as a bubble, raised from the plane of the shell material and then shaped into a rivet button, to fit closely within a hole in the operating tab. After the tab is placed around the button, and set flat against the exterior (public side) of the end, the top of the button, passed through the hole on the tab, is staked, i.e. forced down onto the tab, to complete an integral rivet, one in which the integrity of the metal of the end is not violated in any way. In that fashion, the tab is attached to the end while the end remains a single unpierced piece of metal, and the end is later attached to the open top of a filled can by known means.

The ends must withstand both internal and external pressures, must not interact unfavorably with the can contents, must at all costs not rupture until opened, and must function efficiently that one time, when the user is ready to open the can, even though it may have had a shelf or storage life of many months. As usage of this type of can package increases, more attention has been given to the economies of metal usage; thinner metal, and different types of metal, are introduced, and these factors in turn affect the ability of the tooling to operate effectively on these different types of metals and still produce, at high speed over long periods of operation, ends which will not rupture and which will perform their one-time opening function when brought into play.

By way of example, the need for adequate buckle strength dictates the types of materials which may be used for making can ends. As pointed out, the trend is to thinner, harder materials, with coatings that have lubricants incorporated in them rather than applied to them. These materials must run properly over tooling systems, but those same systems must be able to work with older materials also. The differences in strength, and in coatings, between such materials create a need for a new approach to tooling design which makes the tooling relatively insensitive to material changes and still able to form acceptable integral rivet joints at the higher operating speeds which now prevail.

Thus, the varieties of metal choice, coatings and end and tab design all combine to present a complex situation to the tool designer. The tooling is typically operated in a reciprocating press, which may be single or double acting, to perform a sequence of progressive operations on the shell, and to attach the tab. A disclosure of one currently operating press/tooling conversion system is found in U.S. Pat. No. Re. 33,061 granted Sep. 19, 1989 to the assignee of this application. The embodiment shown in that patent has two lanes of tooling stations and produces two ends simultaneously, however, newer version of that system utilize three lanes, and operate at speeds in the order of 600 strokes/-min. Thus, the tooling must operate rapidly, very accurately, and over long operating periods. It is common to run such conversion presses 22 hours/day, allowing 2 hours/day for maintenance or repair.

Considerable attention has been given to methods and tooling for the above-described operations. Tooling is designed to define the area of the end from which the bubble is formed, and to cause the metal of that area to flow in certain ways. Different specific processes, and tooling to carry out such processes, have been used over the past years to accomplish this purpose. Such prior processes can be generally characterized as including one or more steps of drawing material from the end and reshaping (usually further drawing) the metal into the rivet button. It has been discovered, however, that to achieve a process and tooling which is essentially insensitive to variations in material, both as to thickness and flow characteristics, it is desirable to minimize drawing of the metal.

It is necessary also to address the tab itself, and the region of the end surrounding the button and from which the button is integrally formed. The trend toward thinner materials has a direct and profound effect on the region of the tab surrounding the hole through which the rivet button is projected. The basic rule is, the thinner the tab material, the greater the area of rivet head needed over the tab to prevent tear out of the tab from the rivet when the tab is actuated, usually by lifting. Need for more material in the finally formed rivet head in turn affects the amount of material, and the uniformity of wall thickness, in the button.

Practically all can ends are formed of coated metal of some kind, usually either aluminum or steel. Typical aluminum materials which have been used are 5000 Series metals, with type 5182 H19 being the predominant choice. Some users have sought to use 3000 Series aluminum, which is widely used for aluminum can bodies. This metal has lower yield and tensile strengths, and has been noticed to be more abrasive to tooling as compared to the 5182 aluminum. Similar situations are found with steel sheet. The more commonly used is T-5 (temper 5) steel, but DR-9 (double reduced) steel is being introduced to this market since it has higher yield and tensile values, but it is more difficult to form.

In the U.S. most coatings are added at the mill (aluminum or steel), and the coated materials are available from the supplier with allowances already incorporated in their specifications. On the other hand, in many foreign countries coatings are applied to metal stock sheet by a third party, or by the can and end manufacturer. Coatings (applied to both sides of the metal sheet), and particularly their processes of application, can make substantial changes in the strength and workability of the basis metal to which the coatings are applied, due primarily to the heat used and the period of time to which the metal is exposed to such heating. Lubricants are added to the coatings, with the trend toward included lubricants which are a part of the coating itself, rather than simply applied to the coating exterior. One reason for this is that externally applied waxes will interfere with printing on the public side of the ends.

The consideration of importance here is that the coating on the metal, however it is created, and regardless of its nature and uniformity, must not be violated during the operation of the tooling on the materials. Metal exposure to can contents can lead to undesirable reactions between the contents and the exposed metal, e.g. beer vs. uncovered steel, or carbonated beverages or certain food products vs. aluminum.

As mentioned, varieties of metal choice, coatings and end and tab design all combine to present a complex situation to the tool designer.

SUMMARY OF THE INVENTION

The present invention provides an improved integral rivet button and resulting rivet, and a process and tooling for forming such a rivet, which utilizes two or more successive coining steps on material surrounding the base of the bubble being formed on the shell part of a can end, thereby causing a flow of material into the region which eventually makes up the walls of the button in its final form. This succession of coining steps, at progressively lesser radii, affords adequate metal in the bubble region to assure ultimate formation of an accurate button, regardless of differences in material thickness or flow, while assuring a strong boundary region about the base of the button to avoid failure of the end in the region immediately adjacent the rivet joint with the applied tab, and while assuring that the rivet head is sufficiently large to prevent tear out of the tab at its juncture with the rivet.

By precise location of the coining of the bubble boundary regions, the button-to-end transition is somewhat hardened and smoothed, such that scoring across this transition will be uniform. The initial coined boundary region is preferably, but not necessarily, about 33% greater in diameter than coined boundaries presently used. This boundary is located close to the juncture of the initial bubble wall with the remainder of the shell, where the curvature of the initial bubble wall is concave in the direction of the bubble top and toward the ultimate public side of the end. The invention also provides a unique coining operation, and tools therefore, at a different location on the initially formed bubble than heretofore practiced.

Furthermore, subsequent coining at one or more locations radially inward from the initial coined boundary causes material to flow into the region from which the button ultimately is formed, and such material can simply be reshaped into a precise button form having improved overall thickness and strength. This can be accomplished without need to compensate for differences in the formability and/or resistance to drawing of different materials, without stressing coatings to the point of rupture, and operating on a substantial variety of materials with essentially the same tooling.

In the forming steps from bubble to button, the tooling design is such that the intermediate shapes formed at progressive tool stations are compatible with the next tooling station to promote a smooth transition of the metal from the formation of the second coined boundary region to the last button formation. This produces a smoother metal reformation, produces a button having more uniform wall thickness, and requires less force on the tooling. Reduced force, as is known, allows greater latitude in locating certain tooling operations away from the center of the tooling.

It has been discovered that the progressive coining operations, and the coordinated smooth shaping of the button, produce an ultimate rivet which, compared to present methods, is approximately 12.5% thicker at its base and exhibits approximately 14% increase in thickness of the rivet head, operating on material having a thickness of 0.0112 inch (0.285 mm). Comparable results have been obtained on material having a thickness of 0.0096 inch (0.245 mm). 3000 Series aluminum body stock material has been used with equal success.

It is therefore the primary object of the invention to provide a new rivet construction, and a new method of forming an integral rivet, particularly forming the button from which the rivet is formed, and to provide unique tooling for making such a rivet; to provide such a rivet, method and tooling which minimizes drawing of the metal of the can end from which the rivet is formed; to provide such a rivet, method and tooling capable of working on a substantial variety of materials, and without rupturing coatings applied to such materials; to provide a rivet having significant increase in its base thickness and head thickness, together with a method of and tooling for producing such an improved integral rivet; to provide a novel method of forming a rivet button in which an initial button is formed from a shell, then a first boundary is formed by coining in the location where the initial bubble wall is concave toward the ultimate public side of the end; to provide progressive tooling for performing the novel rivet button forming method, which tooling is especially adapted to accommodate previous intermediate shapes of bubble and button so as to form first the bubble, and then the rivet button, with minimized drawing of metal and with minimum pressure of the tooling on the metal of the shell.

Other objects and advantages of the invention will be apparent from the following description, the accompanying drawings and the appended claims.

BRIEF DESCRIPTION OF THE DRAWINGS

FIGS. 1A through 1E are progressive drawings of the formation of a typical can end, and are labelled "prior art";

FIGS. 2A through 2C are progressive partial cross-section drawings of the rivet connection between a tab and shell, illustrating the opening of a panel in the can end, and are labelled "prior art";

FIGS. 3A through 3H are enlarged drawings of the bubble to button forming sequence in a typical prior art system, and are labelled "prior art";

FIGS. 4A through 4D are schematic drawings of an enlargement of the bubble and button areas of a can end showing the location of coining steps in the formation of a rivet button according to the invention;

FIGS. 5A through 5H are progressive drawings made from enlargements of photographs taken of a cross-section of the bubble-to-button sequence of steps performed according to the invention, with tooling constructed according to the invention;

DESCRIPTION OF PRIOR METHODS

Figure 6:
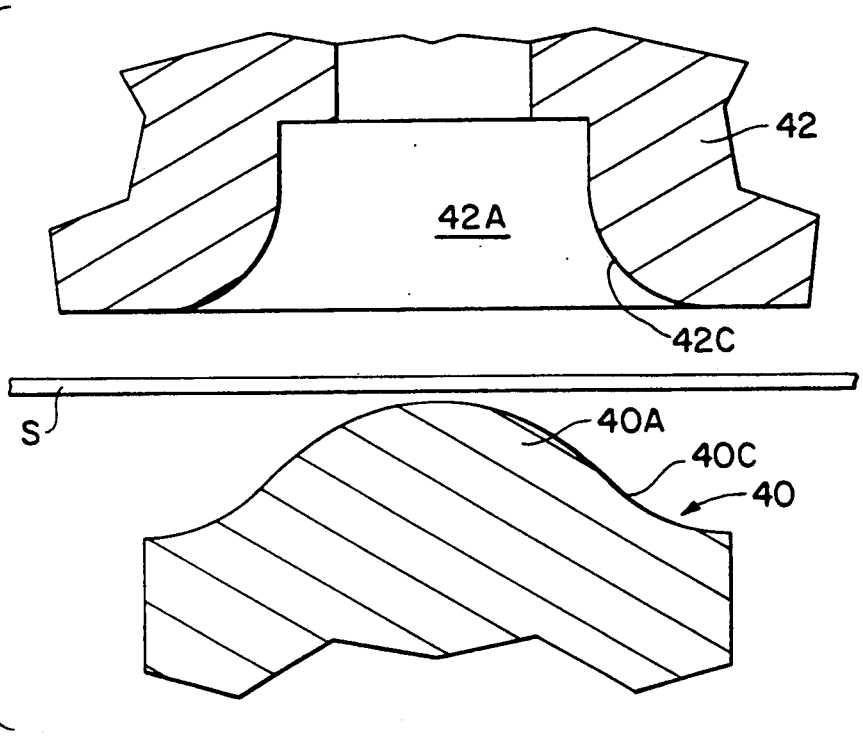
FIGS. 6 through 9 are enlarged partial cross-sectional views through the first bubble forming station of tooling constructed according to the invention, illustrating the functions performed to define the first or original bubble from a shell, and to define the first coined boundary.

Referring to the first sheet of drawing, FIG. 1A shows in plan view the upper or public side of a shell which forms the basic element of a can end. FIG. 1B shows the shell with a typical bubble formed at its center, and FIG. 1C shows the shell with opening instructions impressed on the public side, and the bubble reformed into a button for receiving the end of a tab. FIG. 1D shows the addition of a score line to the shell, which defines the opening panel to be partially separated from the end, together with reinforcement ribs along the opposite edges of the score line; the direction of one end of the score line across the base region of the button is to be noted. FIG. 1E shows the public side of a completed end with tab attached.

FIG. 2A shows an enlarged cross-section of the tab-shell integral rivet joint, with the button extending through the hole in the rivet island of the tab, and the top of the button staked onto the top surface of the tab rivet island. FIG. 2B shows the action during initial lifting of the opening tab, including forming a vent opening in the body or shell portion of the end at the button base, and the inception of panel separation action. FIG. 2C shows the tab pivoted essentially to the extremity of its opening motion, and the opening panel deflected in a pivoting motion through the product side of the can end.

FIGS. 3A through 3H show the progression of the bubble formation and the bubble-to-button transformation. Indicated on these drawings by the legend CN are the initial location of a coined boundary region on the bubble formation (FIG. 3A), and the ultimate location of this coined region of the metal, located just outside the base region of the finished button (FIG. 3H). In this typical prior art operation, the bubble material inward of the coined region is, of necessity, drawn and thinned to achieve the final button shape. The material from which the button must be formed is defined as the area within the circle of the coined boundary region, e.g. the region between the legends CN in FIG. 3A.

The coining operation occurs about a region of the bubble where the bubble wall is predominantly concave toward the public side of the shell. A typical such operation is described in U.S. Pat. No. 3,638,597 issued Feb. 1, 1972. The tooling used produces a net flow of material divided (usually about equally) between inward and outward along the bubble wall. It should be noted that after the initial coining operation (FIG. 3A) further action on the bubble results in a step-like intermediate configuration (FIG. 3B), with the button being formed from the slightly domed central portion of the bubble. The coined region eventually may be ironed to return it to the plane of the surrounding material of the shell (FIGS. 3G and 3H), but there is a characteristic reduced or stepped bubble base where the coined metal finally resides (see FIG. 3H). This can many times be observed by inspection with the naked eye.

In actual practice, variations of this bubble-button forming sequence are practiced, but it can be said that all have the common sequence of forming a first bubble with a coined plateau-like boundary in its center, having a diameter in the order of 0.301 inches (7.650 mm). This central area of the bubble is then effectively pushed through a button die with an abrupt edge which forms the entry boundary for the bubble material. The button punch has, heretofore, simply pushed the bubble material into an effectively open-ended button die, and the wall and head of the button has been shaped by the stroke of the button punch and die, carrying material upward and stretching, almost extruding, the material between the spaced cylindrical walls of the button punch and die. This inherently causes thinning of some portion of the button head and/or side wall, and the interior height of the prior art button (measured from the product side) is essentially the height of the button punch which pushes the metal into the button die, before the base of the button is ironed or coined.

DESCRIPTION OF THE PREFERRED EMBODIMENT

FIGS. 4–20 illustrate the steps of forming an all purpose integral rivet, and particularly the formation of a rivet button, according to the invention, together with an example of preferred tooling for accomplishing this purpose. It should be understood that the cooperating progressive tooling (punches and dies) shown are enlarged several times from normal size, and that only the central segments of the tooling are illustrated. These are the parts of the tooling which are relevant to the formation and reforming of the bubble and then the button, from which an all purpose rivet is formed according to the invention.

Referring to FIG. 4A, according to the present invention, in a first step the material at the bubble location is lightly drawn to form a shallow bubble 20 and at the end of the drawing the larger diameter boundary region 22 is coined. This coining action, as is known, causes flow of metal in opposite direction from such boundary region. By locating the coining region where the bubble wall has a lesser slope, in the region where the bubble wall is convex in the direction of the public side of the bubble (and ultimate end), and by shaping the cooperating faces of the punch and die such that the coining action is more intense outwardly of the boundary region, the predominant metal flow at this step is directed inwardly, toward the center of the bubble area, thus adding to the material subsequently available for final button formation. By using only a light draw and a moderate coining pressure, thinning of the shell portion around the ultimate button area is minimized.

Next, the bubble 20 is reformed and again coined at a lesser radius, in a next tooling station, to form a second boundary region 23 smaller than the first coined boundary region and to cause further flow of metal into the bubble area. This results in a net thickening of the central wall of the bubble, particularly just radially inward of the second coined region. It is from this central area of the bubble that the side walls and top of the button are to be formed.

The now thicker walls of the bubble area are then re-shaped in a further station, essentially without drawing or thinning of the metal beyond its original thickness, into a button 20B with relatively straight side wall 24, a top 25 slightly thinner than side wall 24, and a strong coined button base 26.

At a later station, when the tab is placed on the shell, with button 20B extending through the button hole in the tab island, a stake punch enters the button on the product side, and a stake anvil moves against the public side of button top 25, staking the button over and substantially peripherally outward of the button hole to form a secure integral rivet connection of the tab to the shell, in well known manner.

FIGS. 5A through 5H are drawings made as tracings of photographic enlargements of cross-sections of actual shells shaped according to the invention. The progressive forms were placed in a stacked arrangement corresponding to the progressive formation of the bubble, and then the button, according to the method of the invention, using prototype tooling. The stacked arrangement was then viewed through an enlarging lens and photographed. The initial bubble formation is shown at FIG. 5A, and the completed button formation is shown at FIG. 5H. Comparison of these views readily shows that the top 25 and wall 24 of the button have substantial wall thickness, just slightly reduced from the thickness of the surrounding parent metal of the shell.

Figure 7:
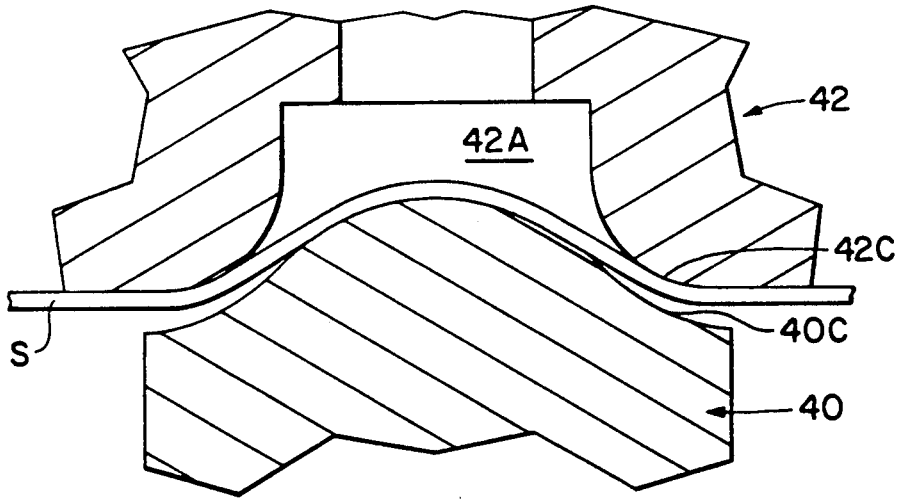
Figure 8:
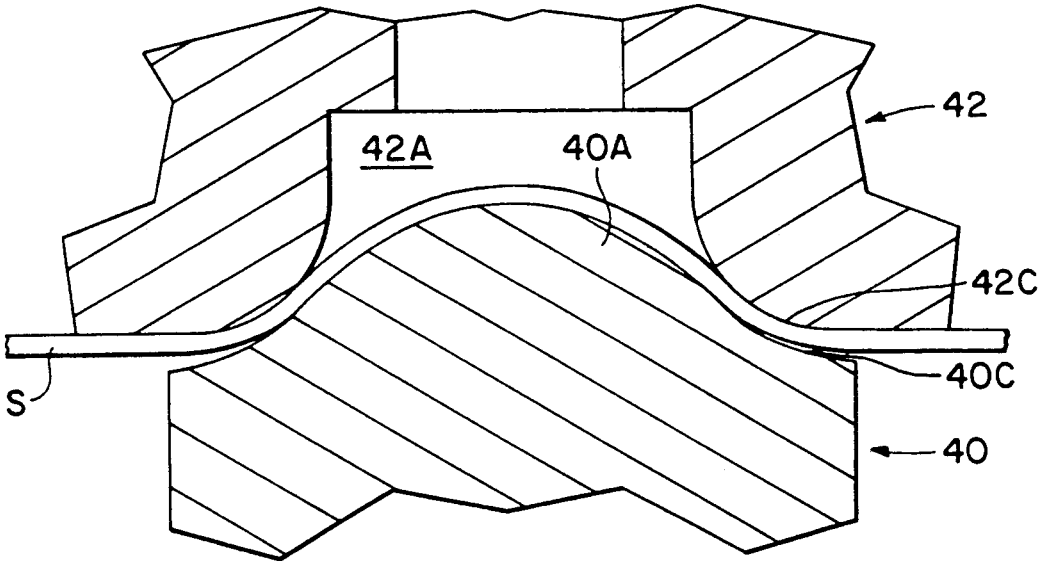

FIGS. 6 through 9 are enlarged cross-sectional views through the first bubble forming station, according to the invention. The first bubble punch 40 and first bubble die 42 are fully opened in FIG. 6, and the central section of a shell S is shown between them, with the ultimate public side facing upward. As the punch and die 40, 42 start to close, the metal of the shell is smoothly and lightly drawn around the domed central region 40A of punch 40 and moved into the cavity 42A of the first bubble station die, as illustrated in FIGS. 7 and 8. When this tooling closes, there is sufficient pressure on the metal of the shell at the closing of the coining parts or surfaces 40C and 42C, at the region CN-1, to form a first coined boundary region around the bubble.

Figure 9:
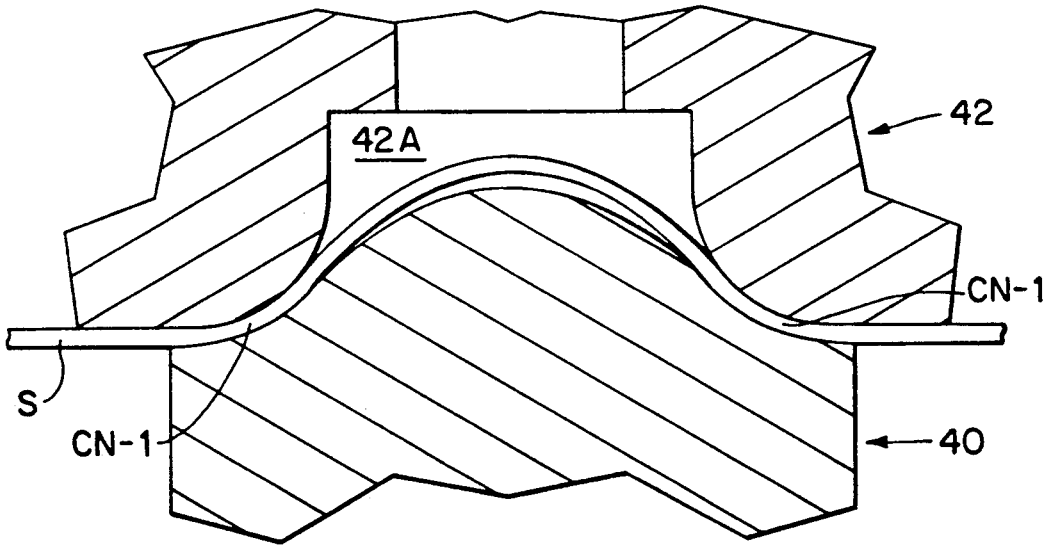
Figure 9A:
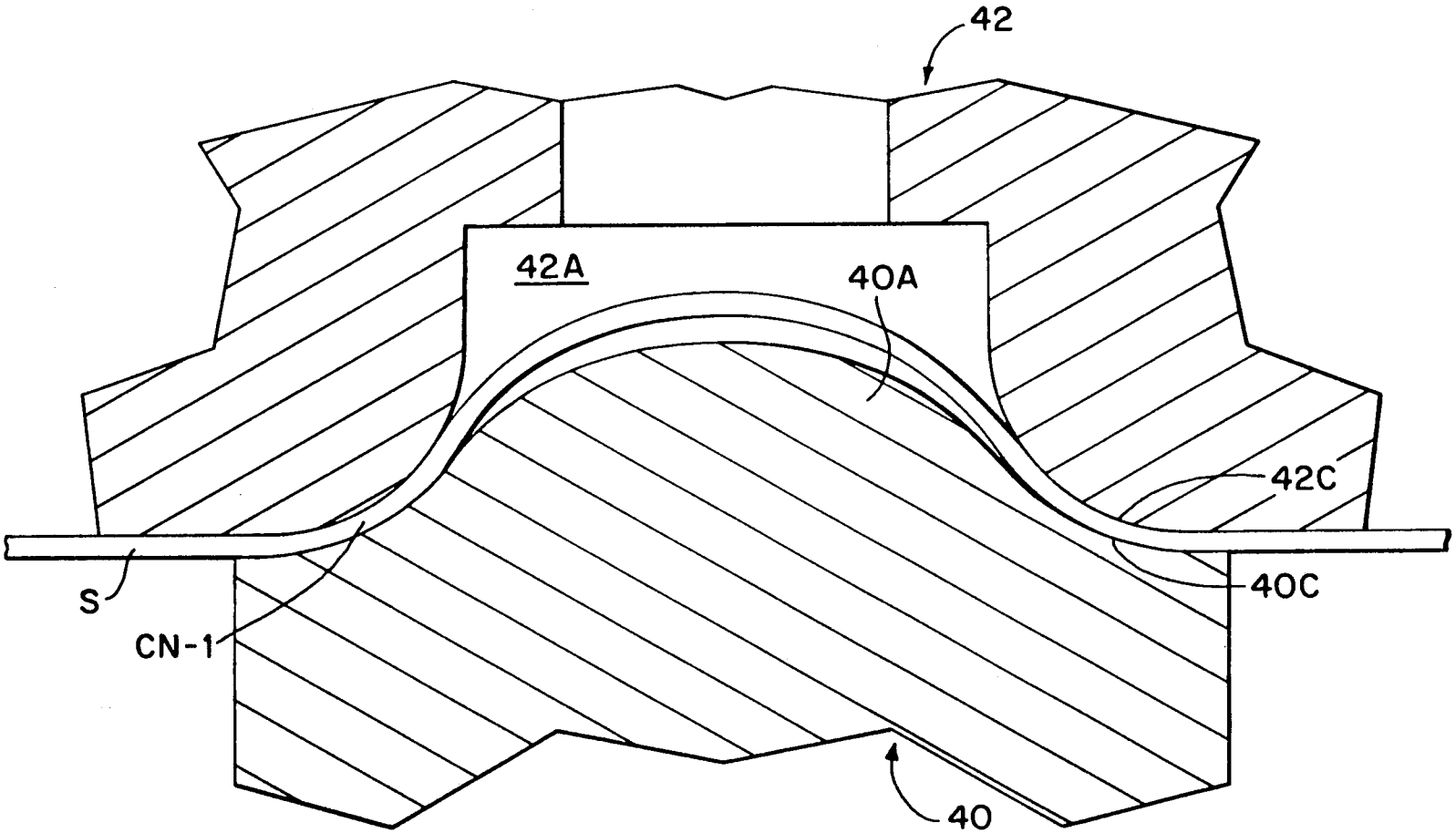
FIG. 9A is a substantially enlarged duplicate of FIG. 9, to better illustrate the first coined boundary and associated tooling.

It should be noted that the surfaces 40C and 42C of the first bubble station punch and die are cooperatively formed such that the first coined boundary region CN-1 tapers slightly in thickness, these surfaces 40C and 42C being closer at the outer edges of the coined boundary. Furthermore, the boundary region is located outward on the initial bubble at a location where the slope of the bubble wall is less than in previous practices, and surfaces 40C and 42C have cooperating radii (see FIG. 9A), the surface 42C having a somewhat sharper curvature than the opposing surface 40C. Thus the predominant flow of metal during this coining action is along the bubble wall toward the center of the bubble.

Stated another way, previous practices resulted in coining between a convex punch and a cooperating concave die surface (as in said U.S. Pat. No. 3,638,597), or in earlier practices on the shell just outside the beginning of the bubble wall (as in U.S. Pat. No. 3,583,348 issued Jun. 8, 1971), whereas in the present invention the initial coining occurs farther away from the center of the punch and die, at a region where the punch and die surfaces when closed define a concave bubble wall area, adjacent the juncture of the initial bubble and the rest of the shell. The coining surface of 40C of the punch is concave, and the coining surface 42C of the die is convex. This is the location of CN-1 in FIG. 9, as opposed to the location of CN in FIG. 3A. It will be noted that this coined boundary is located where the bubble wall is concave toward the public side of the shell (and ultimate end).

Figure 10:
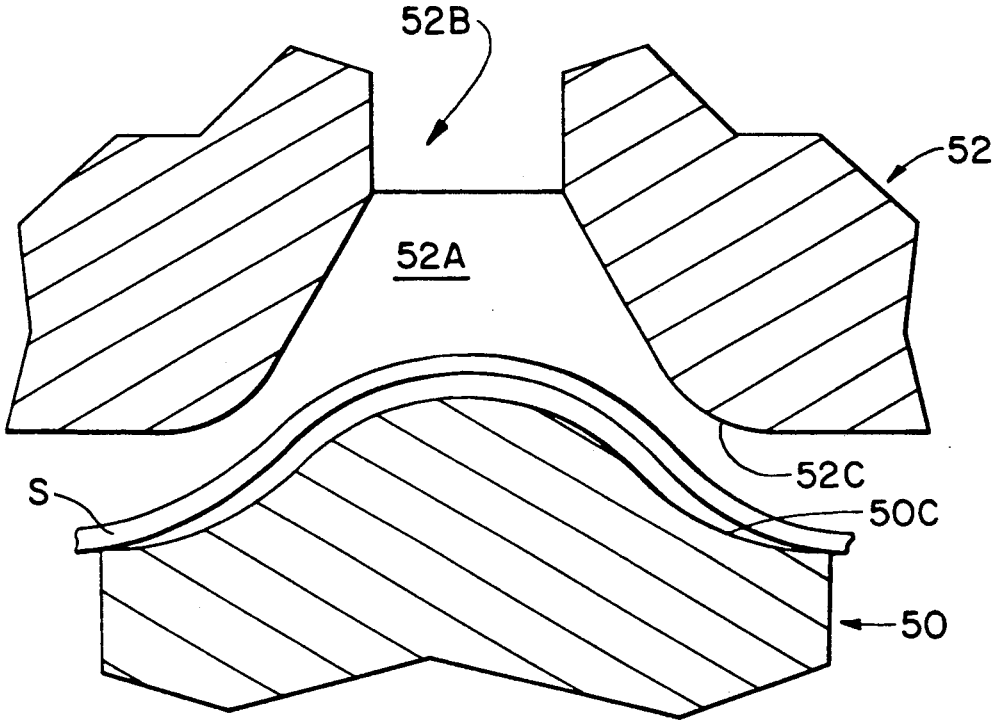
FIGS. 10 through 13 are similar enlarged partial cross-sectional views taken through the second bubble forming station of the tooling.
Figure 11:
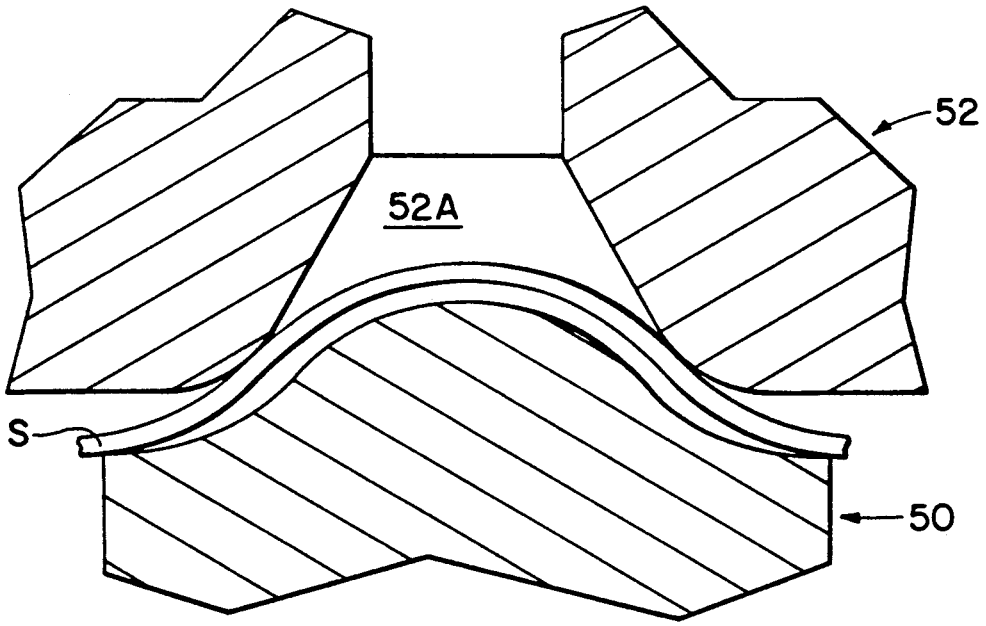
Figure 12:
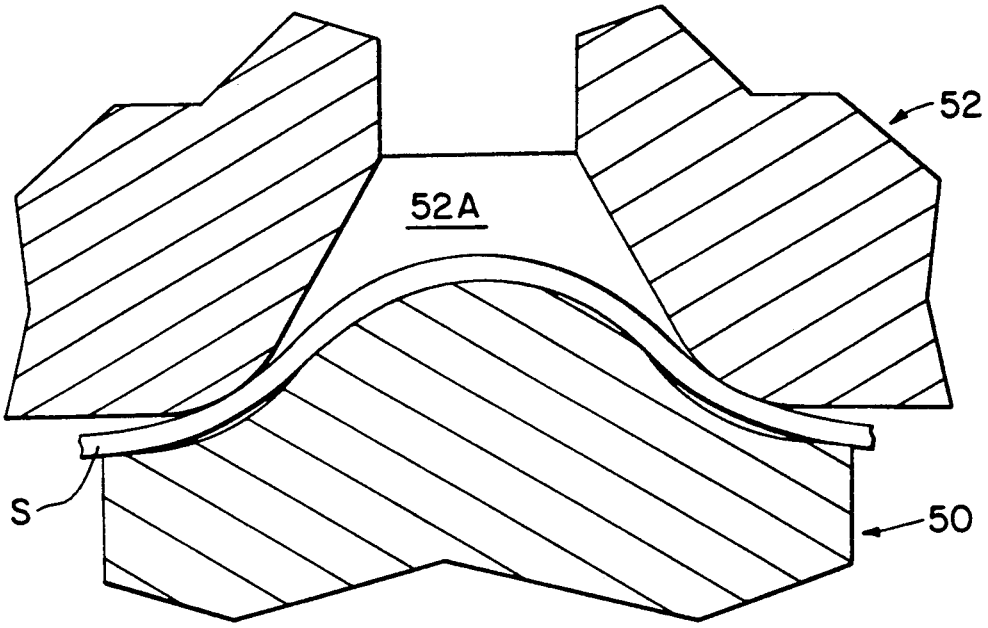

The shell is then transferred to the second bubble forming station, between punch 50 and die 52, as shown in FIG. 10, where the tooling is just beginning to close. It will be noted that punch 50 has approximately the same configuration as punch 40 of the previous station. However, die 52 has a wide throat 52A tapering into a narrower upper but still open region 52B. The diameter of throat 52A is somewhat less than the diameter of the region CN-1.

Figure 13:
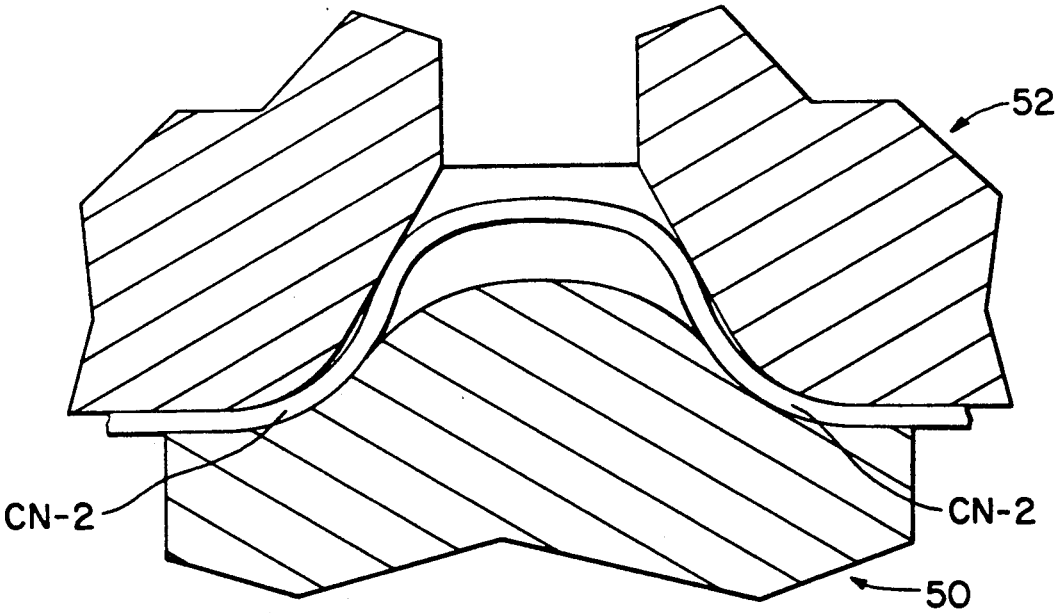
Figure 14:
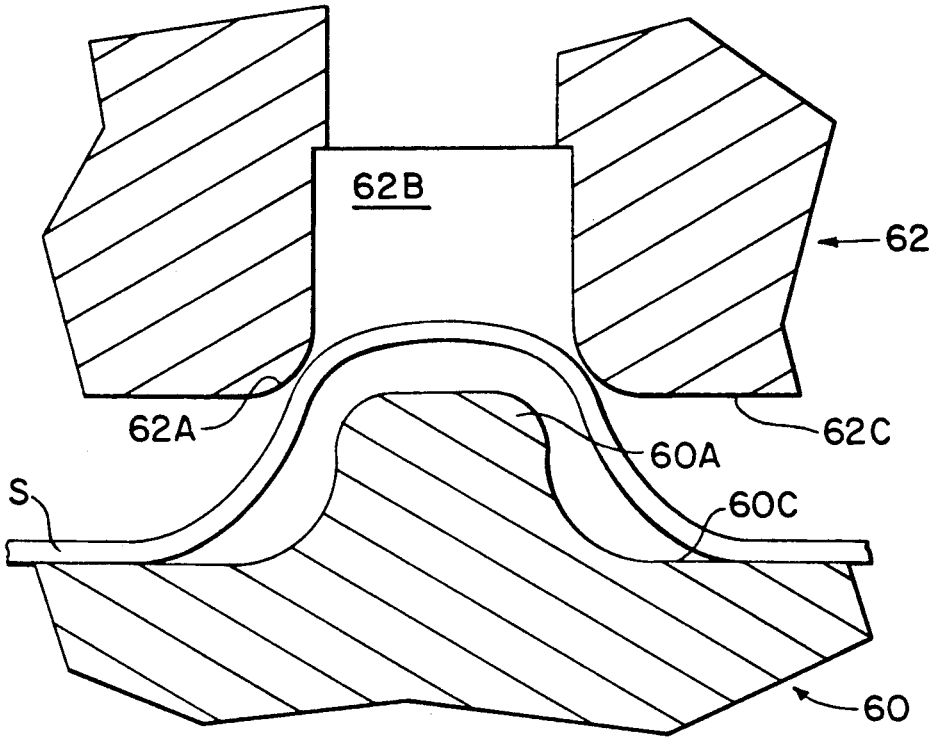
FIGS. 14 through 18 are similar enlarged partial cross-sectional views taken through the button forming station of the tooling, showing the progression at the end of which the button has achieved its general shape.
Figure 15:
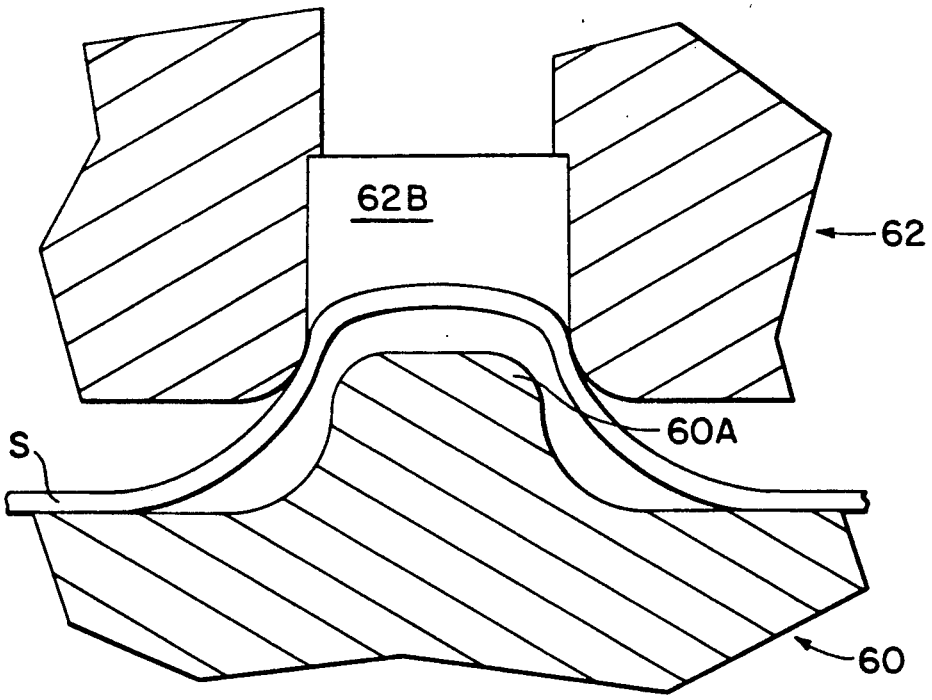
Figure 16:
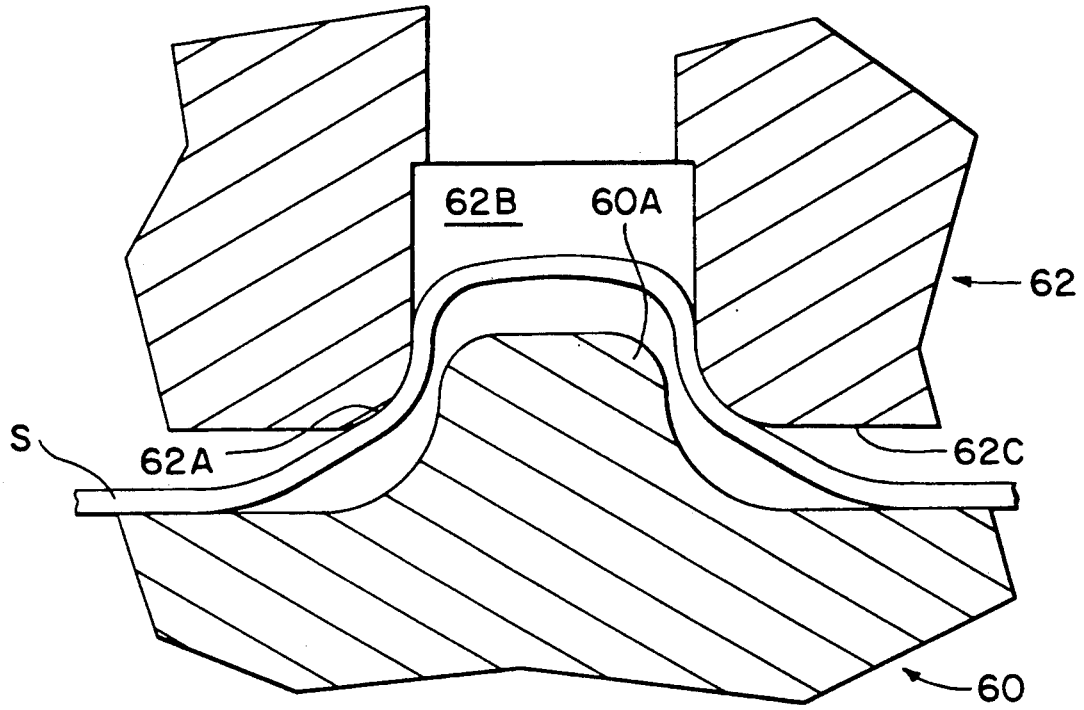
Figure 17:
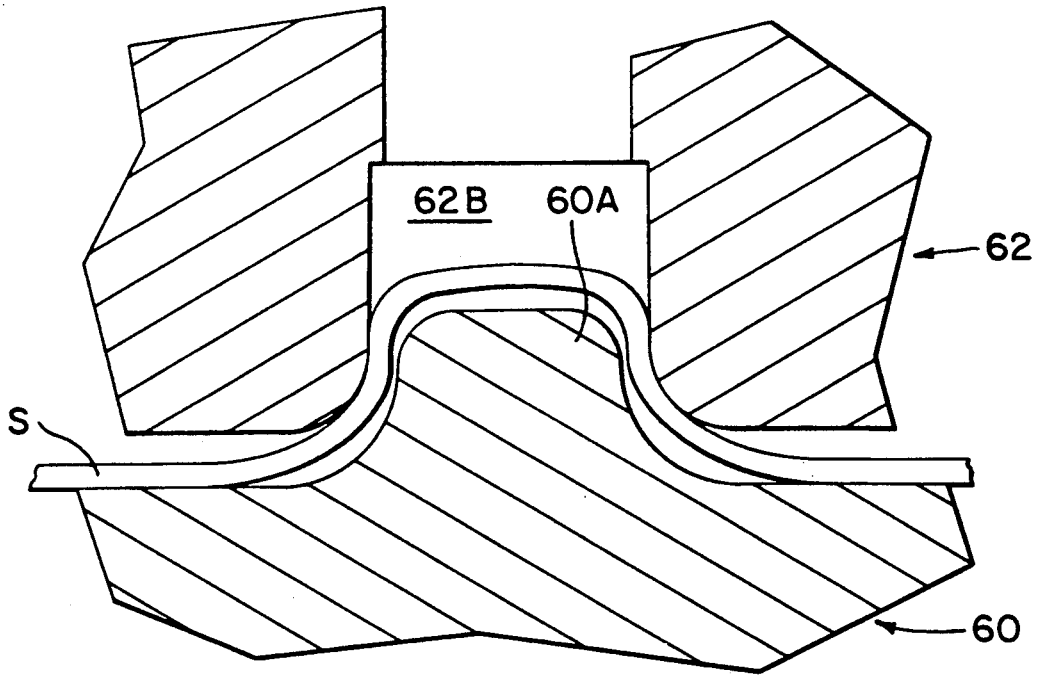

As the tooling of the second bubble forming station closes, the bubble wall is pushed and reformed into the tapered throat 52A, and when the tooling fully closes, its coining surfaces 50C and 52C coin the bubble at a second boundary region CN-2, of lesser diameter than the boundary CN-1, and at the location of bubble wall thickening which has occurred as a result of the first coining operation. This action further moves the material of the bubble toward its center, and raises that center off the punch 50B as shown in FIG. 13. This reforming of the bubble occurs without further drawing of the metal in the bubble area and is a result of the action of the second coining and also of the relatively wide tapered throat 50A which is compatible in shape to the first bubble, as can be seen particularly in the sequence of FIGS. 11 and 12.

FIGS. 14 through 18 show the tooling of the third or button station, including button punch 60 and its pilot head 60A, and button die 62 with an entry throat 62A which is comparable in internal diameter to the exterior of the second bubble form as it leaves the second bubble station, e.g. after FIG. 13. The button die also has a generally cylindrical cavity 62B which is dimensioned to cooperate with the exterior of pilot head 60A to define the side wall of the button, as this tooling closes and the bubble is pushed into cavity 62B. It will be noted, however, that the height of the reformed bubble (FIGS. 13 and 14) is greater than the height of the pilot head 60A, thus the head of the button is not thinned, and is reformed only to a minor amount, as can be observed by comparing FIGS. 14, 15 and 18.

Figure 18:
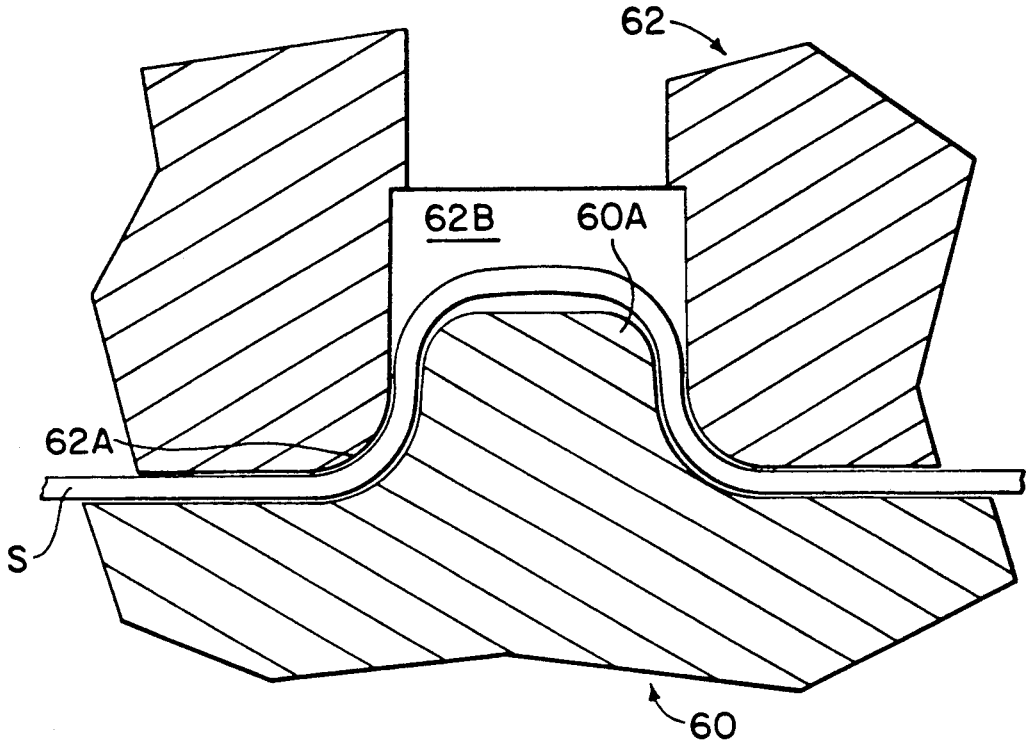

The metal just inside the second coined boundary CN-2 is now located at the base of the button 25, and closing of the button forming tooling, as shown in FIG. 18, produces some additional light coining at the button base radius, to assure that the boundary around the base of the button is ironed to a flat and smooth surface on the product side, preparatory to making the score which defines the opening panel, and the end of which score extends across a portion of this base radius. In this regard, the area 62C of die 62, radially outward of throat 62A, may be tapered slightly upward away from the related punch surface 60C, to produce a gentle increase of metal thickness at the button base radius to the surrounding parent metal of the shell. The amount of this taper may be in the order of 1° outward and upward, as viewed in FIG. 18, it being understood that the full radially outward extent of the punch and die are not shown.

Figure 19:
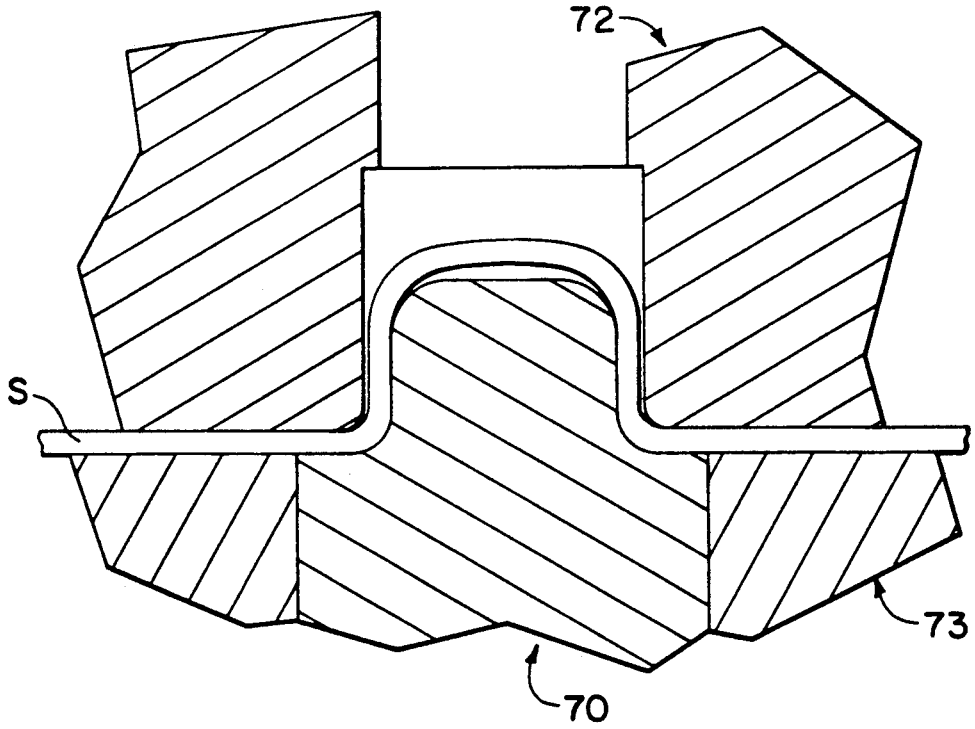
FIG. 19 is a similar enlarged partial cross-section of the button re-strike station showing its punch and die, closed on the button to form its final shape, particularly at the base radius of the button.
Figure 20A:
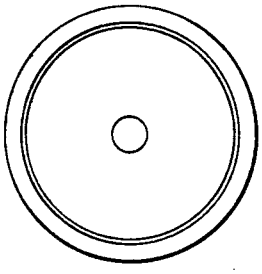
FIG. 20 is a diagram illustrating the progressive formation of a container end at the various stations of tooling in a typical operation according to the invention.
Figure 20B:
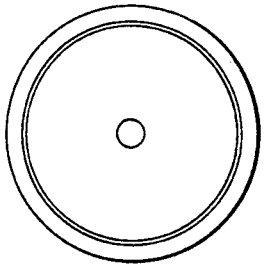
Figure 20C:
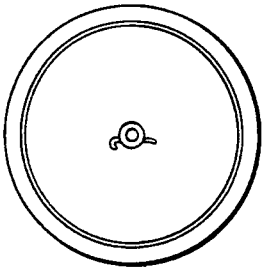
Figure 20D:
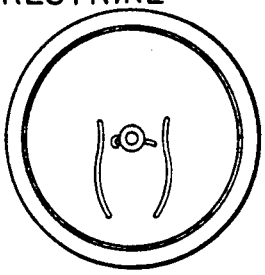
Figure 20E:
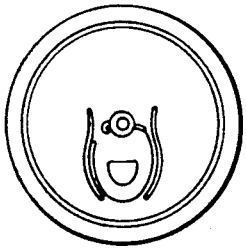
Figure 20F:
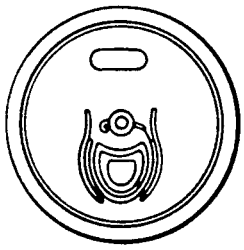
Figure 20G:
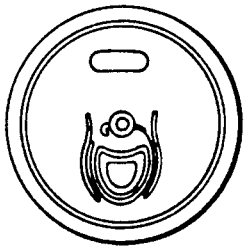
Figure 20H:
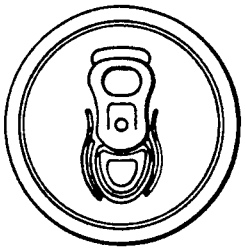

FIG. 19 shows the punch 70 and die 72 at the next or re-strike station of the tooling; punch 70 is surrounded by a retainer 73, a portion of which is shown. Comparing the button shape here to the shape in FIG. 18, it will be noted that the cooperating radii at the throat of die 72 and the base of punch 70 are sharper and the side wall of the button is extended much closer to the metal of the shell S. The punch pilot 70 A is undersize as compared to the inside of the button formation as produced in the button station tooling (FIGS. 14–18) so the button is supported internally during the re-strike tooling operation, but the parts of the button above its base radius are not reformed. Some coining will occur around the base of the button which is in the region wherein the vent (FIG. 2B) occurs when the end is initially opened. FIGS. 5G and 5H show the transition of the button due to the action of the re-strike tooling.

Thus, the tooling stations required for the bubble and button forming operations of the preferred embodiment include first and second bubble forming stations, a button forming station, and a re-strike station. This adds one station to most present day tooling, but as can be seen for example from FIG. 7 of said U.S. Pat. No. Re. 33,961, there is an idle station in most present tooling, so the station sequence of the preferred embodiment can be retrofitted into existing conversion systems. A sequence of progressive stations according to the invention is shown in FIG. 20, with the stations appropriately labelled.

It should be understood that various modifications are possible within to the scope of the invention. For example, the initial bubble may be formed in an operation within the separate systems which previously form the shells, and then the conversion operations on the shell might begin with coining of the boundary of that pre-formed bubble. It is possible even to perform the first coining operation in the shell manufacturing system, but that may add complication, expense, and precision and power demands to the shell system which are avoided by the preferred embodiment.

The improved button, which results from use of the invention of the method, is characterized by a visible difference exhibited at and around the juncture of the button with the remainder of the end. Contrary to the condition shown in FIG. 3H, there is no defined step or steps in the metal surrounding the button, and instead there is a gradual transition of the bubble base into the surrounding parent metal.

While the method and the tooling for performing the method, and the rivet product, all herein described, constitute preferred embodiments of the invention, it is to be understood that the invention is not limited to this precise method, tooling and product, and that changes may be made therein without departing from the scope of the invention which is defined in the appended claims.

What is claimed is:

1. In a method of forming an integral rivet in a container end for attachment of a tab to the end, the improvement comprising the steps of a) displacing an area of metal from the plane of material of a generally flat shell to form a dome-like bubble consisting of the material from which the rivet is to be formed, said dome-like bubble being defined at its periphery by a generally circular first boundary where said region joins the remainder of the shell, b) coining the material of the shell around said first boundary and thereby causing metal flow into the dome-like bubble, then c) reshaping the bubble inwardly of the first boundary to heighten said bubble and d) coining the material of the thickened bubble wall about a second generally circular boundary which is of smaller radius than said first boundary, thereby causing a further flow of material from the second boundary into the bubble.

2. The method defined in claim 1, wherein steps (a) and (b) are performed at the same tooling station.

3. The method defined in claim 2, wherein steps (c) and (d) are performed at the same tooling station.

4. The method defined in claim 1, wherein step (d) is performed on the thickened bubble wall inward from the first boundary.

5. The method defined in claim 1, further including e) re-forming the bubble after step (d) into a button having a top and side wall.

6. The method defined in claim 5, further including f) re-forming the base radius of the button.

7. A method of forming a button in a container end, from which button an integral rivet is formed, to attach an operating tab to the end, the improvement comprising the steps of a) displacing an initial bubble from the surface of a thin metal shell from which a can end is formed, b) successively coining on the shell circular boundaries of decreasing radius, and after each such coining, causing the metal within such boundaries to flow inwardly thereof along the direction of the bubble wall, c) as the metal flows inwardly re-shaping the metal of the bubble wall into a second bubble formation, and d) then shaping the re-formed bubble into a button formation having a generally vertical cylindrical side wall surmounted by a top wall.

8. A method of forming a button in the shell part of a metal container end, from which button an integral rivet is formed for attaching an operating tab to the end, the improvement comprising the steps of a) displacing an initial wide bubble from a thin metal shell from which a can end is formed, b) producing a first continuous boundary on a shell by coining the portion of the shell located at the juncture of the initial bubble and the remainder of the shell and thereby also displacing metal along the bubble wall toward the center of the initial bubble, then c) moving the metal of the bubble wall within said first boundary inward and toward the bubble center to re-form the initial bubble, then d) producing a second continuous boundary by coining a portion of the bubble wall within said first boundary, then e) moving the metal of the re-formed bubble wall within said second boundary inward along such wall and further away from the first boundary and forming of such metal an initial button having a generally cylindrical side wall surmounted by a top, and then f) reforming the initial button into an integral button having a generally cylindrical side wall extending generally perpendicular to the shell plane and a top extending across the side wall.

9. A method of forming a button in a container end, from which button an integral rivet is formed, to attach an operating tab to the end, the improvement comprising the steps of displacing an initial bubble from the surface of a thin metal shell from which a can end is formed, coining in separate steps on a shell, closed boundaries of decreasing radius, the first circular boundary being located at the perimeter of the initial bubble, after the first coining causing the metal within such boundaries to flow inwardly thereof, and, as the metal flows inwardly along the bubble wall shaping the metal to a re-formed bubble before the second coining step, then shaping the re-formed bubble into a button formation having a continuous side wall upstanding from the shell and surmounted by a top wall, and re-striking the button formation to smooth and reduce the curve of the base radius of the button and to reform the button side wall.

10. A method of forming a button in a container end, from which button an integral rivet is formed, to attach an operating tab to the end, the improvement comprising the steps of a) forming a first bubble from a region of the shell and coining a continuous boundary near the periphery of the bubble, said boundary being located at a location where the curvature of the bubble wall is concave in the direction of the top of the bubble, b) then re-shaping the metal within such boundary to a re-formed bubble and thereby displacing metal along the bubble wall toward the center of the bubble, c) then shaping the re-formed bubble into a button formation having a generally vertical continuous side wall surmounted by a top wall.

11. The method defined in claim 10, including the further step of d) re-striking the button formation to smooth and reduce the curve of the base radius of the button and to reform the button side wall.

12. Apparatus for forming a button to be converted into an integral rivet in a container end for attachment of a tab to the end, comprising a) means for displacing an area of metal from the plane of material of a thin metal shell to form a dome-like initial bubble consisting of the material from which the rivet is to be formed, said initial bubble being defined at its periphery by a generally circular first boundary adjacent where said bubble joins the remainder of the shell, b) means for coining the material of the shell around said first boundary and thereby causing metal flow into the dome-like bubble, and c) means for reshaping the dome-like bubble inwardly of the first boundary to heighten the bubble and coining the material of the reshaped bubble about a second generally circular boundary which is of smaller radius than said first boundary, thereby causing a further flow of material from the second boundary into the reshaped bubble.

13. Apparatus as defined in claim 12, further including d) means for reforming the reshaped bubble into a button.

14. Apparatus as defined in claim 13, further including e) means for re-striking the button to reduce its base radius.

15. Apparatus as defined in claim 14, wherein means (a) and (b) is comprised of a first bubble punch and die cooperating upon closing on the shell material to form the bubble and then coin said bubble to form the first boundary, means (c) is comprised of a second punch and die cooperating upon closing to reshape the bubble and then to coin the shell material to produce the second boundary, means (d) is comprised of a third punch and die, and means (e) is comprised of a fourth punch and die.

16. Apparatus as defined in claim 15, wherein said second die is constructed to accept the shape of the bubble subsequent to the first coining.

17. Apparatus as defined in claim 15, wherein said third die is constructed to accept the configuration of the reshaped bubble.

18. Apparatus as defined in claim 15, wherein said fourth die is constructed to accept the shape of the button produced from the third punch and die.

19. Apparatus for forming a button to be converted into an integral rivet in a container end for attachment of a tab to the end, comprising a) a first station including a first punch and die for displacing an area of metal from the plane of material of a generally flat shell to form a dome-like bubble consisting of the material from which the rivet is to be formed, said dome-like bubble being defined at its periphery by a generally circular first boundary formed by a first coin upon closing of said first punch and die where said bubble joins the remainder of the shell, thereby causing metal flow into the dome-like bubble, b) a second station including a second punch and die, said second die being configured to accept the shape of the first bubble, for reshaping the dome-like bubble inwardly of the first boundary to heighten said bubble and upon closing to coin the material of the reshaped bubble about a second generally circular boundary which is of smaller radius than said first boundary, thereby causing a further flow of material from the second boundary into the reshaped bubble, and c) a third station including a third punch and die, said third die being configured to accept the shape of the reshaped bubble, for reforming the reshaped bubble into a button.

20. Apparatus as defined in claim 19, further including d) a fourth station including a re-strike punch and die, said re-strike die being configured to accept the shape of the button formed at the third station, for re-striking the button to reduce its base radius.

21. Apparatus for forming a button to be converted into an integral rivet in a container end for attachment of a tab to the end, comprising a cooperating punch and die for displacing an area of metal from the plane of material of a thin metal shell to form a dome-like initial bubble consisting of the material from which the rivet is to be formed, said initial bubble being defined at its periphery by a generally circular first boundary adjacent where said bubble joins the remainder of the shell, coining surfaces on said punch and said die for coining the material of the shell around said first boundary and thereby causing metal flow into the dome-like bubble, said punch coining surface being concave and said die coining surface being convex, and said coining surfaces coacting to form the first boundary at a region of the shell which is concave in the direction of the top of the bubble.

* * * * *